United States Patent [19]

Fischer et al.

[11] Patent Number: 4,891,885

[45] Date of Patent: Jan. 9, 1990

[54] METHOD OF MAKING A KNIFE HAVING A SCALLOPED CUTTING EDGE

[75] Inventors: Robert R. Fischer, Michigan City; W. James Fischer, Valparaiso, both of Ind.

[73] Assignee: Urschel Laboratories Incorporated, Valparaiso, Ind.

[21] Appl. No.: 109,518

[22] Filed: Oct. 19, 1987

[51] Int. Cl.[4] ..... B26B 9/02

[52] U.S. Cl. ..... 30/355; 76/101 A; 83/55

[58] Field of Search ..... 30/355, 357, 1; 76/101 A, 101 R; 83/55

[56] References Cited

U.S. PATENT DOCUMENTS

| | | | |
|---|---|---|---|
| 3,213,514 | 10/1965 | Evans | 76/101 R |
| 3,863,538 | 2/1975 | Behnke | 30/355 |
| 4,119,004 | 10/1978 | Ludwig | 30/355 X |
| 4,660,453 | 4/1987 | Fischer et al. . | |
| 4,706,524 | 11/1987 | Fischer et al. . | |

*Primary Examiner*—Frank T. Yost
*Assistant Examiner*—Willmon Fridie, Jr.
*Attorney, Agent, or Firm*—Bacon & Thomas

[57] ABSTRACT

A scalloped cutting edge is formed on a knife blank by disposing the blank between corresponding faces of a punch and die assembly, whereby a resilient face of the punch comprises the blank into a plurality of scallop-shaped depressions formed in the face of the die, thereby imparting a corresponding scalloped configuration to the edge portion of the blank.

7 Claims, 7 Drawing Sheets

FIG. 1
PRIOR ART
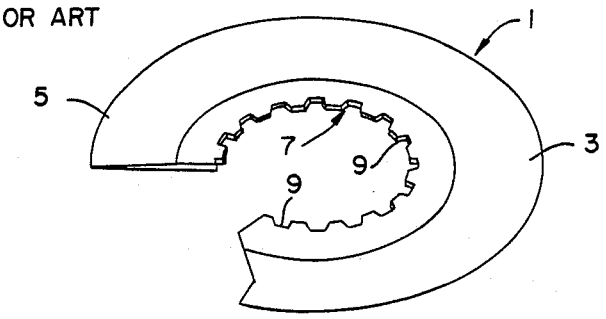
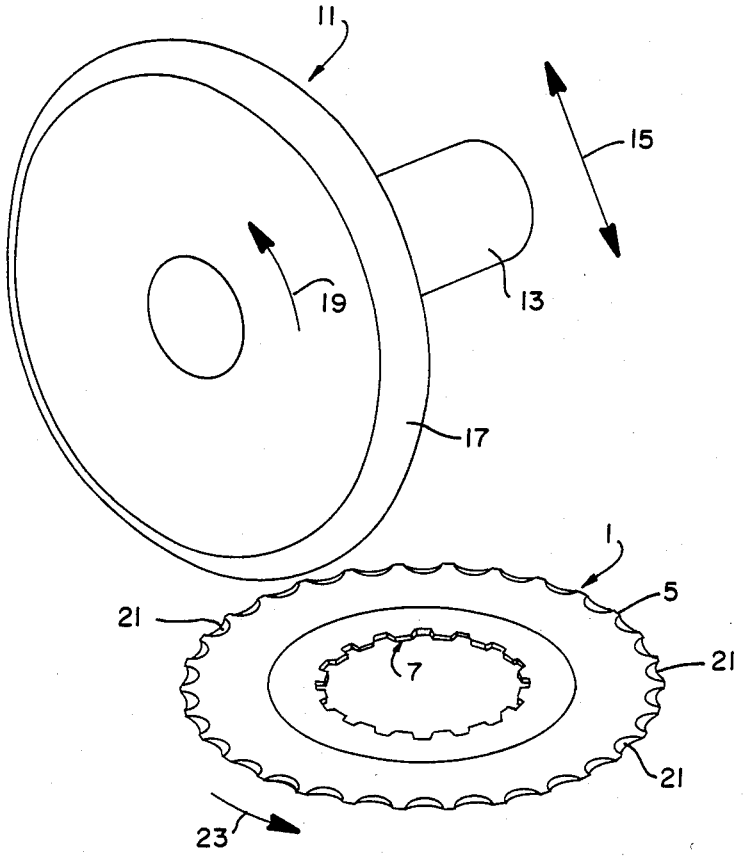
FIG. 2
PRIOR ART

METHOD OF MAKING A KNIFE HAVING A SCALLOPED CUTTING EDGE

BACKGROUND OF THE INVENTION

1. Field of the Invention

The present invention generally involves the field of technology pertaining to the production of knives. More specifically, the invention relates to an improved method of forming a scalloped cutting edge on a knife blade.

2. Description of the Prior Art

A circular or straight knife blade having a smooth linear cutting edge performs at optimum efficiency when the cutting edge is in a sharpened condition. A sharp cutting edge permits the blade to move through the product being cut as the blade rotates or reciprocates, thereby separating the product into two pieces. When a linear cutting edge of such knives become dull, the blade slides on the product without cutting same, a situation which is often realized when the product is tough or has a tender inner portion covered by a tough skin or shell, as in the case of certain agricultural products.

It is known that if the cutting edge is defined by a series of circular segments, commonly referred to as a scalloped edge, the product being cut will be subjected to a series of slashing cuts which will cause the surface of the product to be ruptured. It is further known that circular and straight knives provided with scalloped cutting edges will continue to perform the cutting function even after the edge becomes dull because of the presence of the multiple cutting edges formed by the scalloped configuration. The advantages afforded by scalloped cutting edges are apparent, particularly in commercial applications, since the cutting edge remains in use for longer periods of time between sharpenings when compared to knives having linear cutting edges. Scalloped cutting edges are often provided on straight knife blades, such as bread knives, used in the home environment, and also on circular knife blades used in commercial slicing machines.

The forming of a scalloped cutting edge on a knife blade according to conventional techniques is a time consuming and expensive procedure. The scallops must be individually ground into the edge portion of the knife blank. This requires the use of a grinding wheel having a circular cross-sectional configuration at its perimeter, with the rotating wheel being lowered against the edge portion of the knife blank. After a scallop is formed, the wheel is then raised and the knife blank is indexed to position itself for the next adjacent scallop. This process continues until all of the scallops are formed. Thereafter, the scalloped edge of the knife is beveled to provide a sharp cutting edge. This conventional procedure is applicable to both circular and straight knife blades.

SUMMARY OF THE INVENTION

It is an object of the invention to provide an improved method of forming a scalloped cutting edge on a knife blade.

It is another object of the invention to provide an improved method of forming a scalloped cutting edge on a circular or straight knife blade.

It is a further object of the invention to provide an improved method of quickly and economically forming a scalloped cutting edge on knife blades of different configurations.

These and other objects of the invention are realized through practice of the invention whereby scallops defining the cutting edge of a knife blade are simultaneously formed by means of a punch and die assembly. The punch is provided with a resilient face portion which compresses the edge portion of a knife blank into scallop shaped depressions formed in the face portion of the die, thereby producing a scalloped edge defined by concave and convex sides in a single step operation. The convex side of the scalloped edge is thereafter beveled to form the sharp cutting edge on the scalloped configuration. This method is applicable to both circular and straight knife blanks.

Other objects, features and advantages of the invention shall become apparent from the detailed description of preferred embodiments thereof, with reference to the drawings wherein like reference characters refer to corresponding parts in the several views.

BRIEF DESCRIPTION OF THE DRAWINGS

FIG. is a perspective view, partially broken away, showing a conventional circular knife blank;

FIG. 2 is a perspective view depicting the formation of scallops on the knife blank of FIG. 1 according to the prior art technique of using a grinding wheel;

DETAILED DESCRIPTION OF THE PREFERRED EMBODIMENTS

Figure 3:
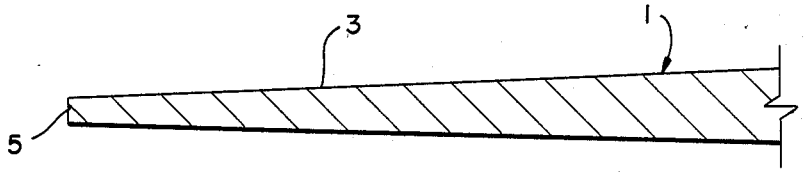
FIG. 3 PRIOR ART
FIG. 3 is a partial cross-sectional view of the periphery of the blade portion of a circular knife blank to the forming of scallops therein.

Prior to detailing the practice of the invention according to a preferred embodiment thereof, a description of the conventional method for forming scalloped cutting edge on a knife blank shall be provided with reference to FIGS. 1–6.

As depicted in FIG. 1, a conventional circular knife blank 1 is shown with a section thereof partly broken away. Blank 1 includes a blade portion 3 which, as seen in the broken-away section, tapers outwardly to a peripheral edge 5. A central opening 7 of circular configuration is provided to permit blank 1 to be attached to a lathe in forming the taper to blade portion 3. This is facilitated by providing the periphery of opening 7 with a plurality of notches 9 so that blank 1 can be attached to a correspondingly shaped splined workpiece holder of the lathe. Blank 1 is typically made by stamping a strip of steel in a punch press which also simultaneously forms opening 7.

A conventional method for forming a scalloped edge on knife blank 1 shall now be described with reference to FIG. 2. As shown therein, a grinding wheel 11 is mounted for rotation on a shaft 13 which may in turn be rotated by any appropriate known power source (not shown), such as a motor and pulley assembly. The construction and operation of grinding wheel 11 and its associated components are entirely conventional and well known in the art. Shaft 13 is also mounted for reciprocating movement in opposite directions indicated by double arrow 15. This permits a periphery 17 of wheel 11 to be advanced towards and retracted from the outer periphery of blade portion 3 of blank 1. The configuration of periphery 17 is substantially circular and corresponds to the shape and size of the desired scallops to be formed in blank 1. The actual forming of the scallops is accomplished by rotating wheel 11 in the direction indicated by arrow 19 and advancing wheel 11 towards edge 5 of blank 1 so that a scallop 21 may be ground therein. Once this has been accomplished, wheel 11 is then retracted away from blank 1, and the latter is indexed by rotating same in the direction of arrow 23 in order to position blank 1 so that wheel 11 may again be advanced thereagainst for grinding the next adjacent scallop 21. This procedure is continued until the entire periphery of blade portion 3 is provided with the desired number of scallops 21.

Figure 4:
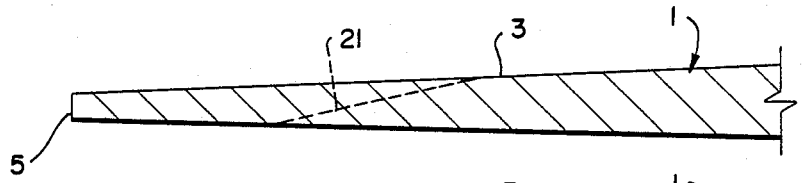
FIG. 4 PRIOR ART
FIG. 4 depicts the blank of FIG. 3 after a scallop has been in the edge portion, as shown in dotted lines.
Figure 5:
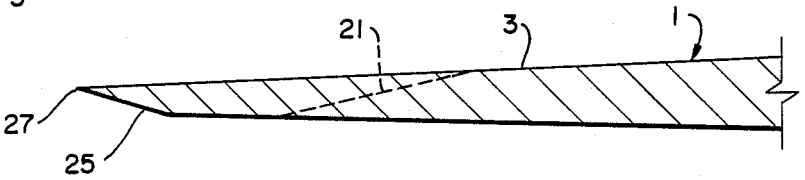
FIG. 5 PRIOR ART
FIG. 5 is the blank of FIG. 4 after the scalloped edge beveled to provide a sharp cutting edge.
Figure 6:
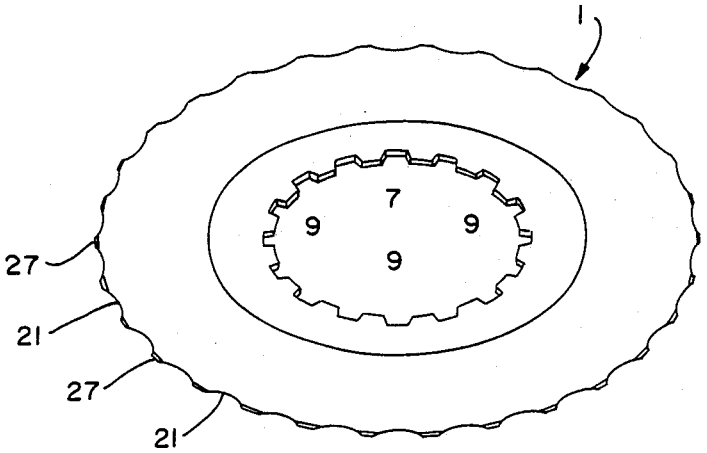
FIG. 6 PRIOR ART
FIG. 6 depicts the reverse side of the scalloped blank shown in FIG. 2 after a peripheral bevel has bee provided to form the completed scalloped cutting edge.

As seen in FIG. 3, blade potion 3 of blank 1 is tapered towards peripheral edge 5 by beveling both sides thereof with a lathe as previously indicated. FIG. 4 depicts a scallop 21 which has been ground into the periphery of blade portion 3 by means of grinding wheel 11. FIG. 5 depicts blank 1 after scalloping and sharpening, the latter procedure being accomplished by grinding a bevel 25 at the outer periphery of blade portion 3 between adjacent pairs of scallops 21 to define a plurality of sharpened cutting edges 27. A completed knife blank 1 provided with a fully scalloped and sharpened cutting edge is shown in FIG. 6.

A method of forming a scalloped cutting edge on a knife blank in accordance with a preferred embodiment of the invention shall now be described with reference to FIGS. 7, 8 and 9. As shown therein, a punch and die assembly 29 is utilized. The basic structure of assembly 29 essentially includes a conventional punch 31 and a cooperating forming die 33. Punch 31 and die 33 are supported within a punch press (not shown) which serves to compress a workpiece disposed therebetween. Punch 31 is fastened to the ram of the punch press, while die 33 is clamped to the bed of the punch press. Any known punch press capable of performing the functions and deemed appropriate for the practice of the invention as described herein may be utilized.

Figure 7:
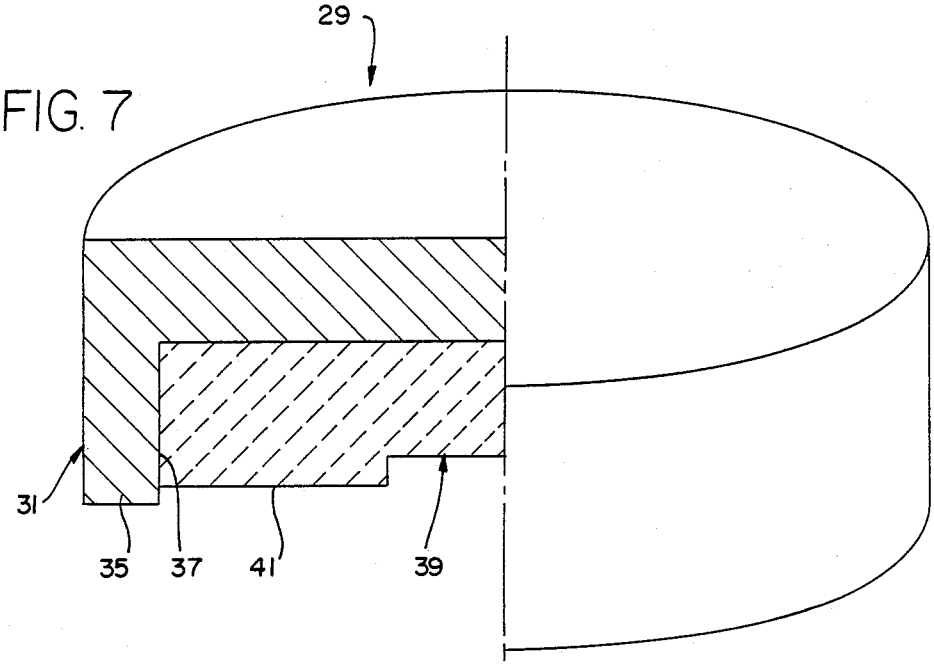
FIG. 7 is a perspective view, partly in section, showing the punch of a punch and die assembly used in the practice of the invention.

With particular reference to FIG. 7, punch 31 is defined by a rigid cup 35 that is preferably formed from metal and provided with an internal cylindrical cavity 37. A high-strength elastic insert 39 is disposed within cavity 37 and provided with a circular-shaped face portion 41. Insert 39 is preferably formed from an elastic, rubber-like substance, such as an elastomer, which possesses high strength and is capable of withstanding extreme deformation without being damaged, while maintaining dimensional integrity upon release of deforming force. Such materials are well known in the punch art and may be selectively utilized to advantage in the practice of the invention as described herein.

Figure 8:
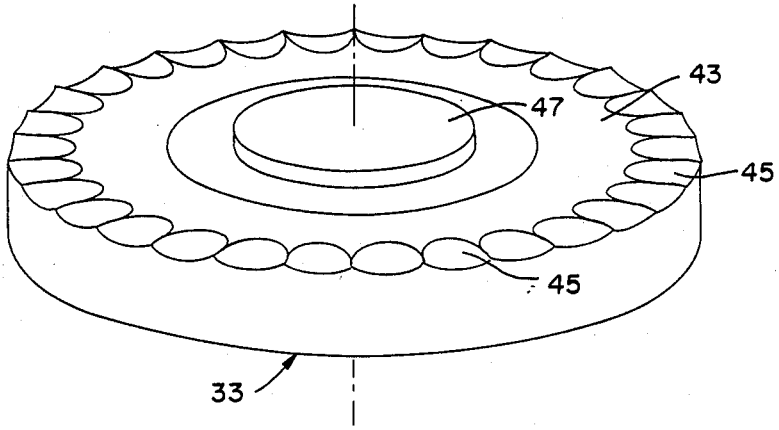
FIG. 8 is a perspective view of the forming die of a punch and die assembly used in the practice of the invention.

As seen in FIG. 8, forming die 33 is supported in opposition to and cooperates with punch 31 for the purpose of compressing a workpiece therebetween. Die 33 is of a cylindrical configuration and preferably formed from any appropriate metal conventionally used in the die field of technology. Die 33 includes a circular face portion 43 provided with a plurality of depressions 45 formed therein and arranged in a circular array around the periphery thereof. Each depression 45 is of a scalloped configuration, and preferably of a somewhat larger dimension than the final size of the corresponding scallop desired to be imparted to a knife blank. Die 33 is also provided with a central hub 47 extending outwardly from face portion 43.

Figure 9:
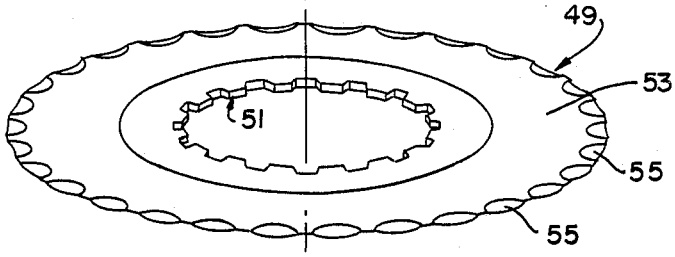
FIG. 9 is a perspective view of a circular knife blank depicting a scalloped edge configuration formed by the punch and die assembly of FIGS. 7 and 8.

A circular knife blank 49 provided with a central opening 51 is shown in FIG. 9. Blank 49 is structurally the same as that of previously described knife blank 1. As apparent, blank 49 is disposed on face portion 43 of die 33 with hub 47 extending through opening 51 so that blank 49 may be centralized on die 33. Blank 49 also includes a circular blade portion 53 which, as shown in FIG. 9, has a plurality of scallop-shaped dimples 55 formed around the outer periphery thereof by punch and die assembly 29.

Figure 10:
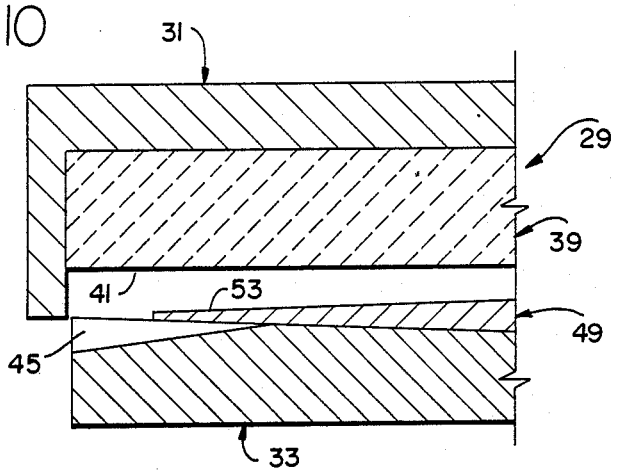
FIG. 10 is a partial cross-sectional view showing the punch, and die assembly of FIGS. 7 and 8 with a circular knife blank disposed therein just prior to compression of the blank.
Figure 12:
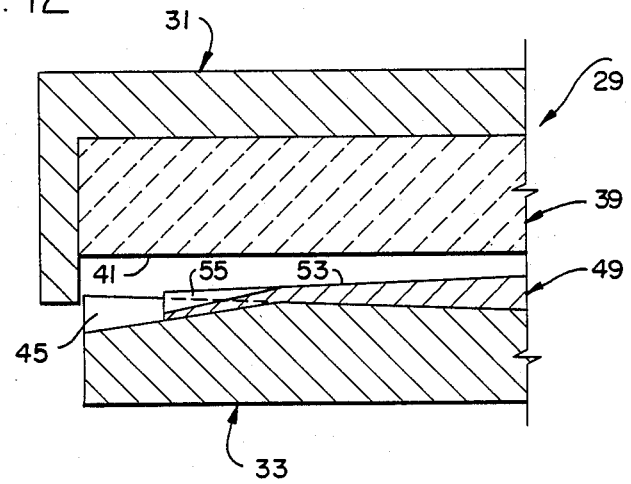
FIG. 12 is the assembly of FIG. 11 after the punch has been raised away from the blank and die.
Figure 13:
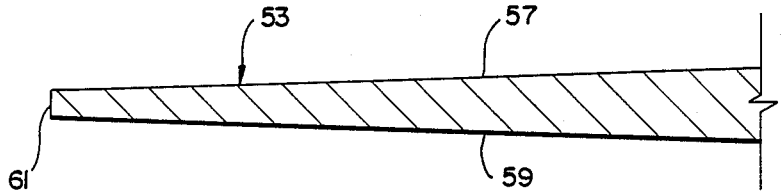
FIGS. 13, 14 and 15 are partial cross-sectional configurations of the blade portion of a knife blank in the three different stages of forming a scalloped cutting edge according to the invention including, respectively, the blank prior to the formation of scallops therein, the blank after scallops have been formed therein, and the scalloped edge after beveling to provide a sharp cutting edge.
Figure 14:
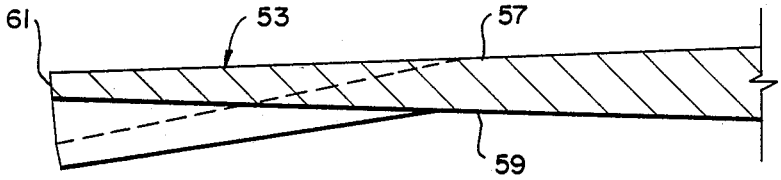

The exact manner in which punch and die assembly 29 forms dimples 55 around the periphery of knife blank 49 shall now be described with reference to FIGS. 10–14. As seen in FIG. 10, knife blank 49 is disposed and centralized on face portion 43 of forming die 33, with the outer edge of blade portion 53 extending over the inward edges of depressions 45. Punch 31 is positioned directly over blank 49 with face portion 41 of insert 39 being disposed directly over the outer edge of blade portion 53 and depressions 45. The diameter of die 33 is slightly less than that of cavity 37 so that die 33 may be received within cavity 37 during downward movement of punch 31. The configuration of blade portion 53 in this position of assembly 29 is shown in FIG. 13, wherein portion 53 is defined by a pair of opposed straight sides 57 and 59 which taper radially outwardly to terminate at a peripheral end wall 61.

Figure 11:
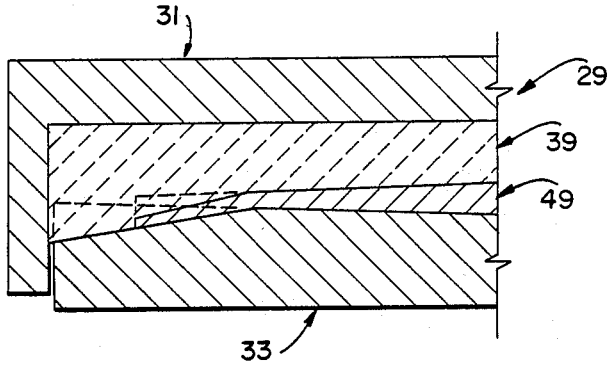
FIG. 11 is the assembly of FIG. 10 depicting full compression of the blank by the punch against the die, and showing the formation of a scallop in the blank.

When force is applied to the punch press, as shown in FIG. 11, punch 31 is caused to close downwardly against die 33 in a single stroke of the punch press. As punch 31 closes over die 33, face portion 41 of insert 39 compresses tightly against the upper surface of blade portion 53 and causes the outer edge thereof to be pressed into depressions 45 of die 33, and thereby assume a corresponding configuration. Thereafter, the punch press is released and punch 31 is withdrawn from die 33, as shown in FIG. 12. Blank 49 is then removed from die 33 and has a configuration shown in FIG. 14. As seen therein, dimple 55 of scallop configuration is formed to extend outwardly of side 59. This configuration is the same for all dimples around the periphery of blade portion 53. Accordingly, each dimple 55 is defined by a convex portion extending outwardly from side 59 and a concave portion extending inwardly from side 57 of blade portion 53.

While punch 31 is disclosed as preferably including an elastic insert 39, it is also possible to utilize a punch formed entirely of metal. In this alternative embodiment, the circular-shaped face portion of the punch shall be provided with male protuberances corresponding in configuration with female depressions 45 of die 33. Such a metal punch may be made in two or more pieces and provided with a spring-loaded center portion for maintaining the central portion of knife blank 49 in a flat condition while the circular-shaped face portion provided with the protuberances moves downwardly to cause the outer edge of blade portion 53 to be pressed into depressions 45 of die 33.

It is therefore apparent that by the practice of this method, scallop-shaped dimples may be quickly and simultaneously formed around the periphery of knife blank 49 in a single step operation through the use of punch and die assembly 29. Moreover, dimples 55 are identical in size and configuration, thereby permitting the rapid production of large numbers of circular knives having scalloped edges of consistent form and quality.

Figure 15:
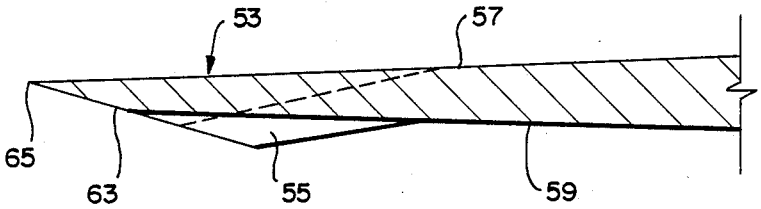

The final step in completing knife blank 49 is shown in FIG. 15 wherein the convex portions of dimples 55 are sharpened by providing same with a peripheral bevel 63 which extends to the terminal end of side 57 and defines a sharpened circular cutting edge 65.

Figure 16:
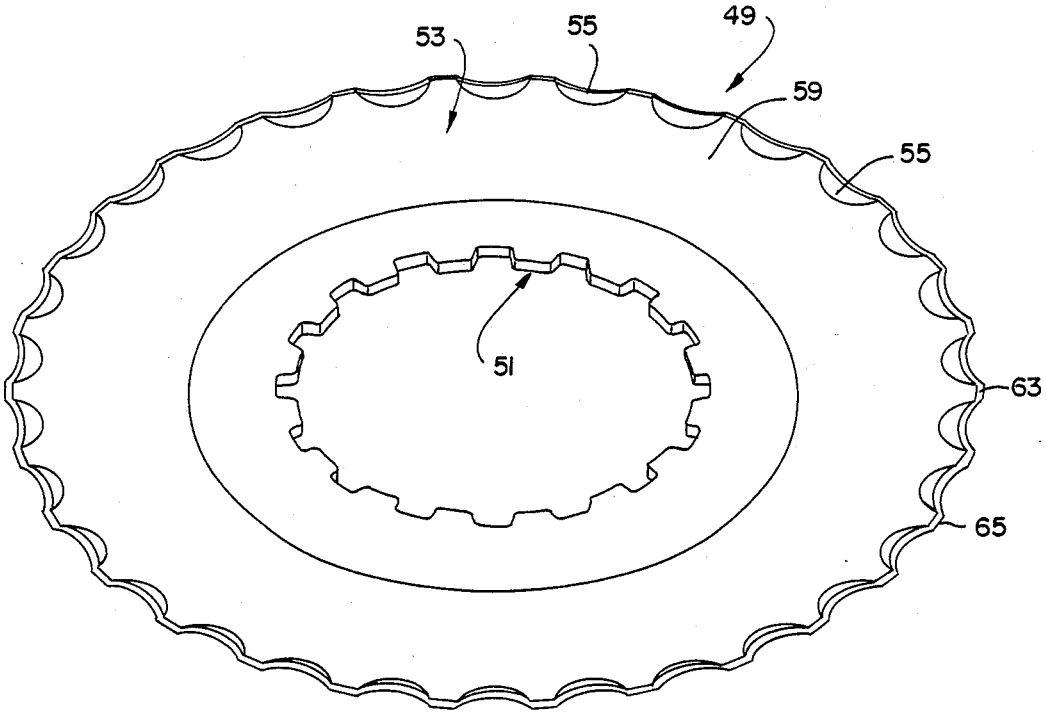
FIG. 16 is a perspective view of a circular knife blank with a completed scalloped cutting edge formed in accordance with the invention, showing the convex sides of the scallops.
Figure 17:
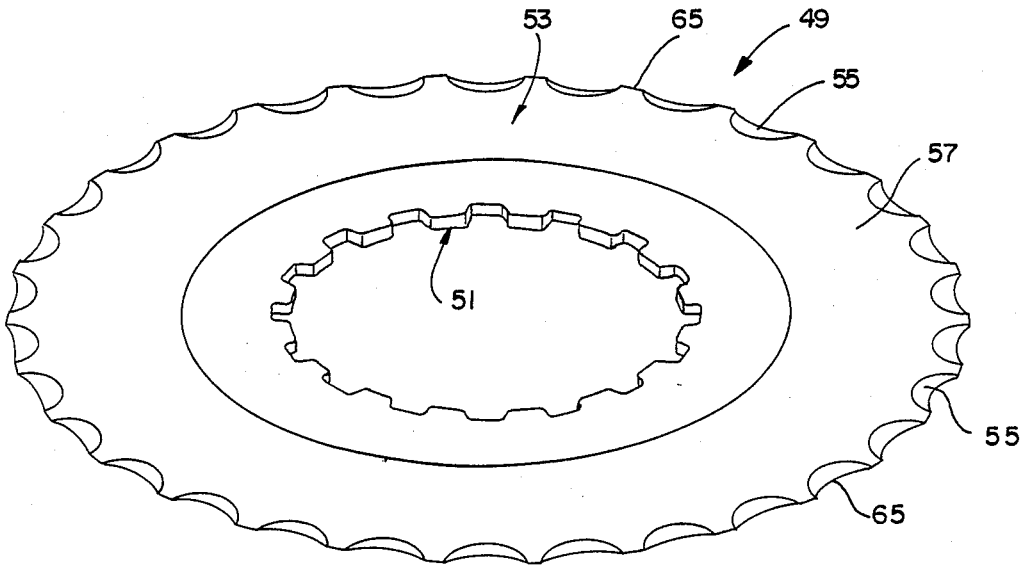
FIG. 17 is a perspective view of the opposite side of the blank shown in FIG. 16, and depicting the concave sides of the scallops.

A completed circular knife blank 49 provided with a sharpened scalloped cutting edge formed by the practice of the invention is shown in FIGS. 16 and 17. As seen in FIG. 16, side 59 of blade portion 53 is visible, thereby depicting the convex portions of scallop-shaped dimples 55. As seen in FIG. 17, side 57 of blade portion 53 is visible, thereby depicting the concave portions of scallop-shaped dimples 55.

Figure 18:
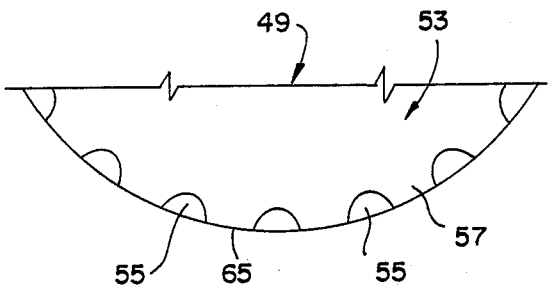
FIGS. 18, 19 and 20 are partial views of a circular knife blank with scallops formed therein and having, respectively, wide, medium and no spacings between the scallops.
Figure 21:
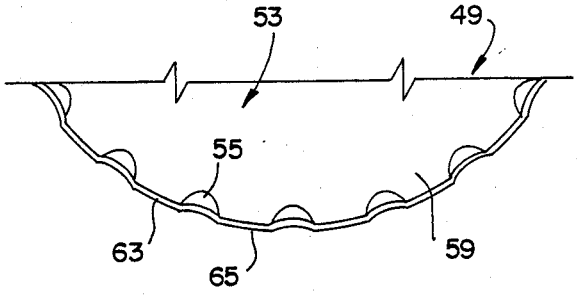
FIGS. 21, 22 and 23 depict, respectively, the blanks of FIGS. 18, 19 and 20 after the scalloped edges have been sharpened.
Figure 19:
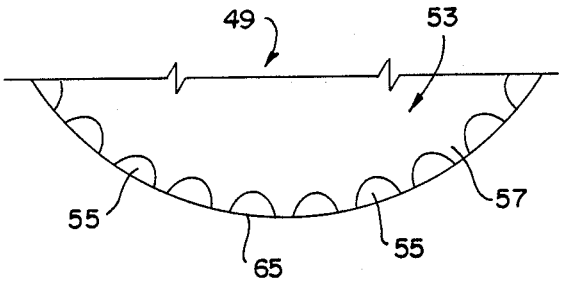
Figure 22:
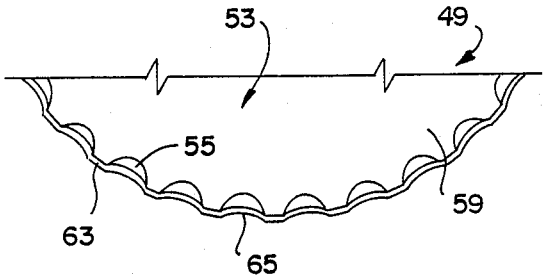
Figure 20:
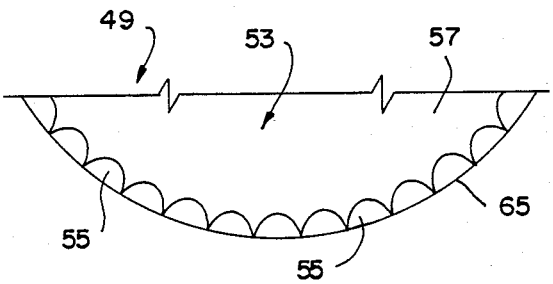
Figure 23:
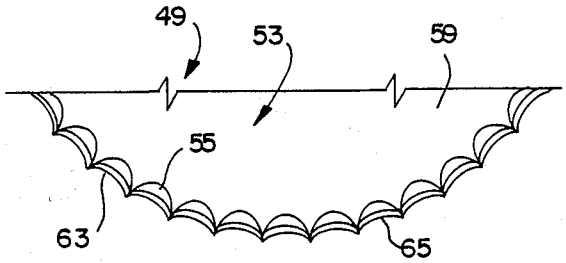

Possible variations of scalloped cutting edge configurations for circular knife blades formed in accordance with the invention are shown in FIGS. 18–23. In FIGS. 18, 19 and 20, there are shown scallop-shaped dimples which may be formed on the periphery of knife blank 49 with, respectively, wide spacings between adjacent dimples, narrow spacings between adjacent dimples, and no spacings between adjacent dimples. The concave portions of dimples 55 are depicted in FIGS. 18–20. FIGS. 21–23 correspond respectively to FIGS. 18–20, and depict the convex portions of dimples 55.

It is to be understood that the embodiments of the invention herein shown and described are to be taken as preferred examples of the same, and that various changes in shape, size, arrangement of parts and composition may be resorted to without departing from the spirit of the invention and/or scope of the subjoined claims.

We claim:

1. A method of forming a scalloped cutting edge on a knife blade comprising the steps of:

(a) providing a punch and die assembly including a first face and a corresponding second face, the second face having a plurality of scallop-shaped depressions formed therein;

(b) positioning a knife blank including an edge portion defined by a pair of opposed planar surfaces terminating at an end wall between the first and second faces; and (c) compressing the first face towards the second face to deform the edge portion of the blank into the depressions of the second face and outwardly of a planar surface thereof to impart a corresponding scalloped configuration to the edge portion, wherein each scallop includes an outwardly extending convex side and a concave side.

2. The method of claim 1 further including the step of beveling the convex sides of the scallops to form a sharpened cutting edge.

3. The method of claim 1 wherein the first and second faces are of circular configuration; and the knife blank includes a circular-shaped edge portion.

4. The method of claim 1 wherein the first face is formed of deformable material.

5. The method of claim 4 wherein the deformable material includes an elastomer.

6. The method of claim 1 wherein the first face is formed of metal.

7. The method of claim 1 wherein the knife blank includes a straight edge portion.

* * * * *

UNITED STATES PATENT AND TRADEMARK OFFICE

CERTIFICATE OF CORRECTION

PATENT NO. : 4,891,885

DATED : January 9, 1990

INVENTOR(S) : Robert R. Fischer and W. James Fischer

It is certified that error appears in the above-identified patent and that said Letters Patent is hereby corrected as shown below:

IN THE SPECIFICATION:

Column 2, line 22, after "FIG.", insert: -- 1 --;

line 29, after "blank", insert: -- prior --;

line 32, after "been", insert: -- formed --;

line 33, after "edge", insert: -- has been --;

line 36, delete "bee", and insert therefor: -- been --.

Signed and Sealed this

Twenty-sixth Day of March, 1991

*Attest:*

HARRY F. MANBECK, JR.

*Attesting Officer*

*Commissioner of Patents and Trademarks*